US008196517B2

(12) United States Patent
Dutoit

(10) Patent No.: US 8,196,517 B2
(45) Date of Patent: Jun. 12, 2012

(54) U-SHAPED SPAN FOR RAILWAY TRACK

(75) Inventor: Daniel Dutoit, Boulogne-Billancourt (FR)

(73) Assignee: Systra, Paris (FR)

( * ) Notice: Subject to any disclaimer, the term of this patent is extended or adjusted under 35 U.S.C. 154(b) by 67 days.

(21) Appl. No.: 11/816,265

(22) PCT Filed: Feb. 13, 2006

(86) PCT No.: PCT/FR2006/000324

§ 371 (c)(1),
(2), (4) Date: May 23, 2008

(87) PCT Pub. No.: WO2006/087456

PCT Pub. Date: Aug. 24, 2006

(65) Prior Publication Data

US 2009/0084048 A1 Apr. 2, 2009

(30) Foreign Application Priority Data

Feb. 16, 2005 (FR) ..... 05 01598
Feb. 18, 2005 (FR) ..... 05 01709

(51) Int. Cl.
*E01D 12/00* (2006.01)
*E01D 2/00* (2006.01)
*E01B 2/00* (2006.01)

(52) U.S. Cl. ..... 104/124; 14/74.5

(58) Field of Classification Search ..... 104/124, 104/125, 126, 119; 14/74.5, 75
See application file for complete search history.

(56) References Cited

U.S. PATENT DOCUMENTS

| | | | | |
|---|---|---|---|---|
| 2,028,741 | A | 1/1936 | Disney | 52/174 |
| 6,684,793 | B2 * | 2/2004 | Dutoit | 104/124 |
| 2002/0162479 | A1 | 11/2002 | Dutoit | 104/124 |

FOREIGN PATENT DOCUMENTS

| | | | |
|---|---|---|---|
| CA | 2 349 315 | | 11/2002 |
| DE | 845 646 | | 8/1952 |
| DE | 914 258 | | 6/1954 |
| DE | 197 23 587 | A1 | 12/1998 |
| EP | 0 010 733 | A1 | 5/1980 |
| EP | 0 331 664 | A1 | 9/1989 |
| NL | 1010307 | C1 | 4/2000 |

OTHER PUBLICATIONS

Search Report, French application No. 0501598, dated Oct. 13, 2005.
Search Report, French application No. 0501709, dated Oct. 13, 2005.
International Search Report, application No. PCT/FR2006/000324, dated Aug. 7, 2006.

* cited by examiner

*Primary Examiner* — Joe Morano, IV
*Assistant Examiner* — Zachary Kuhfuss
(74) *Attorney, Agent, or Firm* — Seyfarth Shaw LLP

(57) ABSTRACT

The invention relates to a span (2) for railway tracks with a self-supporting U-shaped structure (3), defining a section of the path for a piece of rolling stock (1), travelling on the railway track and at least one further element (6, 10, 11, 14) for the travel of the rolling stock (1) on the railway track and which can support, guide and/or supply the rolling stock (1). According to the invention, at least one (6) of the additional elements (6, 10, 11, 14) is directly integrated in the U-shaped element (3).

11 Claims, 3 Drawing Sheets

U-SHAPED SPAN FOR RAILWAY TRACK

Figure 1:
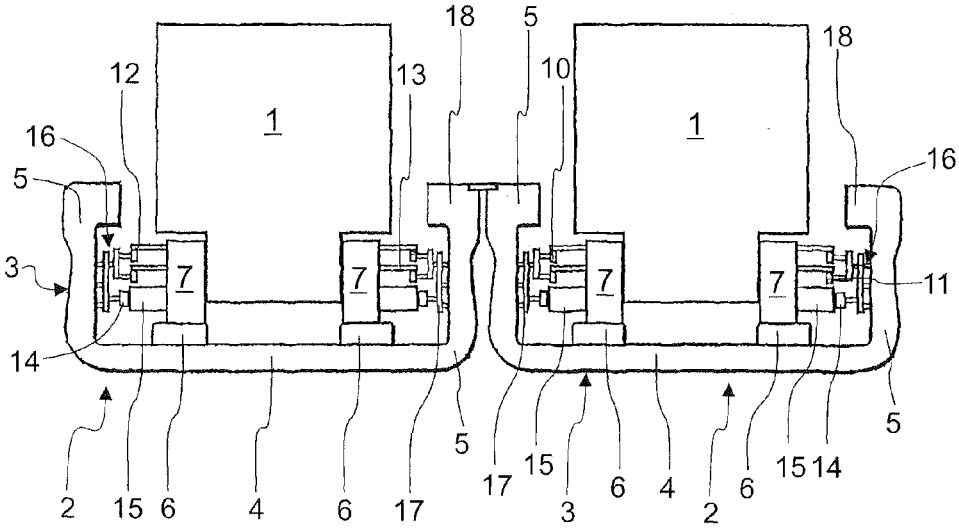

This invention relates to a span for a railway track, whether the rolling stock is on tires or on a rail. As a matter of fact, in this application, not only a railway track as such is called a railway track, i.e., a track with bearing rails on which rolling stock rolls, but also a track with a running rack, i.e., a track for rolling stock with wheels equipped with tires, of the subway on tires type.

A span such this is known, of the type formed by a U-shaped structure defining a portion of the path of the rolling stock, the U-shaped structure including a slab supporting the railway track and two substantially vertical side walls.

The path of the railway track is defined by the assembly of the various U-shaped structures. Some of these U-shaped structures, made of concrete, were prefabricated off-site, and their assembly considerably facilitates the construction of the railway track. However, prefabricated U-shaped structures make it possible to simplify only the construction of the carcass work.

This invention aims to produce a span including a U-shaped structure of the aforesaid type and making it possible to simplify the integration of additional finishing elements which enable movement of the rolling stock.

According to the invention, the span for a railway track comprises a self-supporting U-shaped structure which defines a portion of a path for a piece of rolling stock running on the railway track, and at least one additional element which enables movement of the rolling stock on the railway track and which is designed to support, guide and/or power the rolling stock, at least one of the additional elements being directly integrated into the U-shaped structure. The additional elements possibly being the electrical power-supplying or guide side rails, the bearing rails or the running track on which the wheels equipped with tires run or on which the bearing rails rest, depending on the type of rolling stock.

Thus, via this configuration, as concerns the running track, its integration means that it is no longer necessary to carry out specific concreting on site (the latter being manufactured at the same time as the U-shaped structure), and, as concerns the rails, their integration makes it possible to fasten them directly to the U-shaped structure without any additional device, a portion of the members for fastening the rails to the U-shaped structure forming an integral part of the U-shaped structure (this portion being made within the structure or fastened to it during the manufacture thereof). Thus, according to the invention, functions linked with the railway system (the track supports, the lateral guide supports and rail power supply), are integrated upon manufacture of the U-shaped structure, which makes it possible to reduce the costs associated with construction of the railway track (beyond the carcass work).

Other characteristics and advantages of this invention will become apparent in the following description of two embodiments, given for non-limiting illustrative purposes and shown in the appended drawings.

Figure 2:
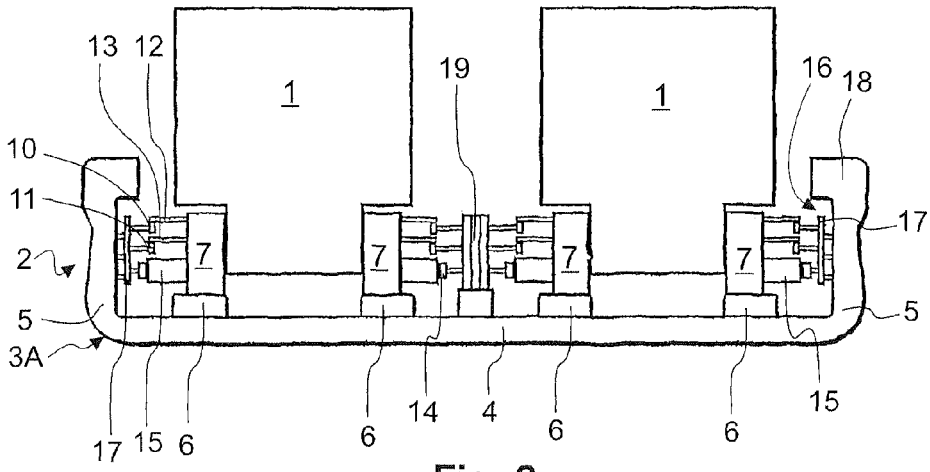
Figure 3:
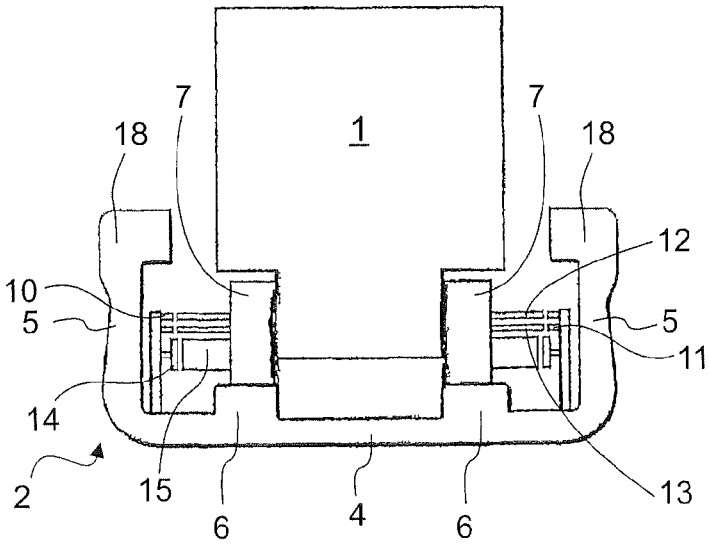
Figure 4:
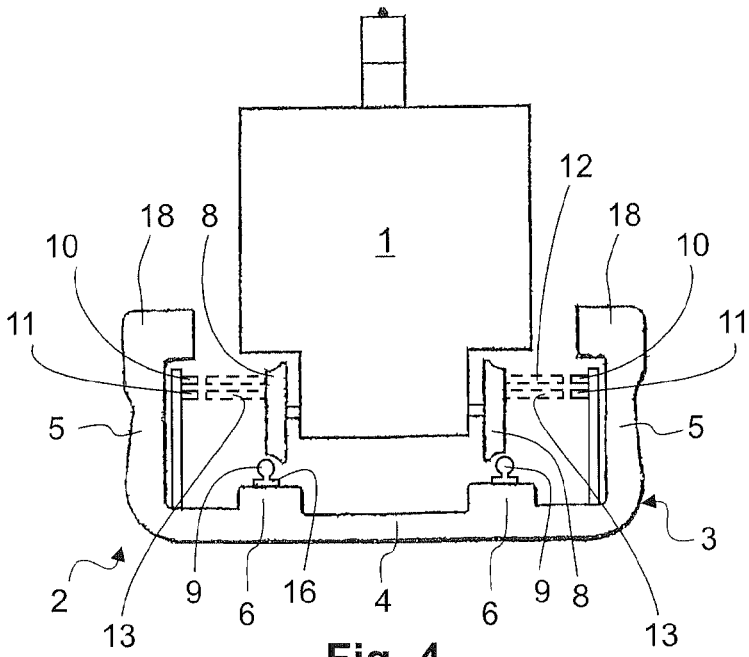
Figure 5:
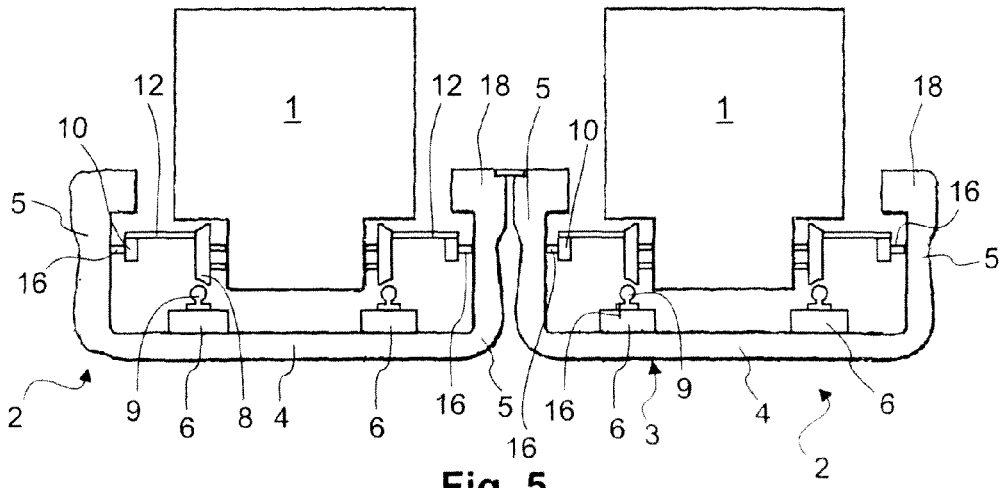
Figure 6:
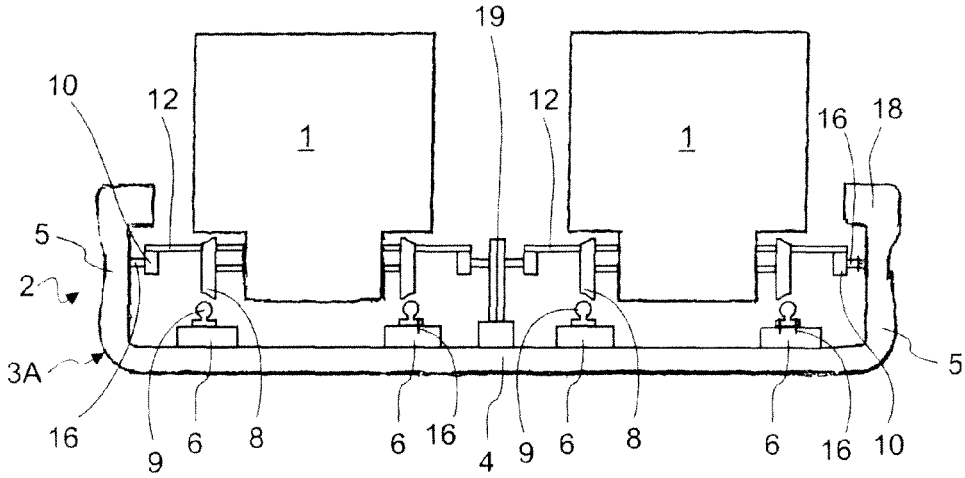

FIG. 1 is a sectional view of two spans according to a first embodiment and arranged one beside the other, for rolling stock on tires, the additional integrated elements being guide and power-supplying side rails, FIG. 2 is a sectional view of a span defining the path of two adjacent railway tracks according to a second embodiment, the additional integrated elements being guide and power-supplying side rails, FIG. 3 is a sectional view of a span according to a third embodiment, for rolling stock on tires, the additional integrated elements being running racks, FIG. 4 is a sectional view of a span according to a fourth embodiment, for rolling stock on rails, the additional integrated elements being running racks and bearing rails, the power being supplied via a catenary system (solid line) or by a side rail (dashes), FIG. 5 is a sectional view of two spans according to a fifth embodiment and arranged one beside the other, for rolling stock on rails, the additional integrated elements being power-supplying side rails, and FIG. 6 is a sectional view of a span defining the path of two adjacent railway tracks according to a sixth embodiment, the additional integrated elements being running racks, bearing rails and power-supplying side rails.

In the examples shown in FIGS. 1 to 6, a railway track for rolling stock 1 is delimited by an assemblage of several spans 2 arranged along side one another.

Each span 2 comprises a structure 3, 3*a*, which defines a portion of the path of the railway track. Each structure 3, 3*a* is U-shaped and includes a substantially horizontal slab 4 supporting the railway track, and two substantially vertical side walls 5 flanking the railway track laterally. In these embodiments, the U-shaped structure 3, 3*a* is a prefabricated structure, in a single piece, made of reinforced concrete capable of being pre-stressed.

Furthermore, according to this invention, since each span 2 is a complete span, each slab 4 is load-bearing and each U-shaped structure 3, 3*a* is self-supporting, which means that it is not supported by another element, such as an intermediate caisson, and that, therefore, in the case of an elevated railway track, each U-shaped structure 3, 3*a* is directly supported by the piers of the corresponding viaduct, and runs from one pier to another.

Each span 2 also includes additional elements 6 enabling movements of the rolling stock 1 on the railway track.

These additional elements 6, 9, 19, 11, 14 include at least one running rack 6 which is designed to support the rolling stock 1. When the latter has wheels with tires 7, the running rack 6 forms the track on which they roll directly, and when the rolling stock 1 has metal wheels 8 rolling on bearing rails 9, the running rack 6 is a sleeper 6 onto which the bearing rails 9 are fastened directly (which are then part of the additional elements 6, 9, 19, 11, 14).

The additional elements 6, 9, 19, 11, 14 can also include at least one side rail 10, 11, 14 arranged at the side of the corresponding railway track, inside the space delimited by the U formed by the U-shaped structure 3, 3*a*. In the first three embodiments, the span 2 includes an incoming electric current side rail 10 and an outgoing current side rail 11, these two side rails 10, 11 enabling electrical power to be supplied to the rolling stock 1, which comprises contact pads 12, 13 designed to rub against these rails 10, 11 so as to establish the electrical connection. Furthermore, in these three embodiments, as the rolling stock 1 is on tires 7, the span 2 also includes a guide side rail 14, the rolling stock 1 comprising guide wheels 15 the axis of rotation of which is vertical, and which rolls against this rail 14 in order to ensure transverse guiding of the rolling stock 1. In the last two embodiments, the span 2 includes an incoming electric current side rail 10 cooperating with contact pads 12 designed to rub against this rail 10, and, as the rolling stock has metal wheels 8 rolling on bearing rails 9, the latter are used as outgoing current rails.

According to the invention, at least one of the additional elements 6, 9, 19, 11, 14, which make it possible to support, guide and/or power the rolling stock 1, is integrated directly into the structure 3, 3*a*, without any additional device for making dimensional and geometric adjustments in the span 2.

In the case of the running rack 6, this means that it forms an integral part of the slab 4 and that, therefore, it was made at the same time as the latter (see FIGS. 3, 4 and 6). In the case of the bearing rails 9 (see FIGS. 4 and 6) or side rails 10, 11, 14 (see FIGS. 1, 2, 5 and 6), this means that they are fastened directly to the U-shaped structure 3, 3*a* (more precisely, for the bearing rails 9, they are fastened directly to the running rack 6 (or even to the slab 4), and, for the side rails 10, 11, 14, to the side walls 5).

In the first three embodiments shown in FIGS. 1 to 3, a set of three side rails 10, 11, 14 is associated with one railway track. In the last two embodiments shown in FIGS. 5 and 6, a single side rail 10 is associated with one railway track.

In the first, second, fifth and sixth embodiments, as car be seen in FIGS. 1, 2, 5 and 6, the side rails 10, 11, 14 are held directly by the side walls 5 of the U-shaped structure 3, 3*a*.

The U-shaped structure 3, 3*a* is dimensioned accordingly so that each side wall 5 holding a side rail 10, 11, 14 withstands not only the vertical forces generated by the rolling stock 1, but also the transverse forces that the rolling stock 1 generates and transmits 5F to the side rail 10, 11, 14.

In these embodiments, the U-shaped structure 3, 3*a* is dimensioned so that each side wall 5 withstands the transverse forces due, on the one hand, to the friction of the contact pads 12, 13 on the electrical power-supplying rails 10, 11, and, on the other hand, the transverse thrust exerted by the guide wheels 15 on the guide rail 14, in particular in the curved portions of the railway track.

Conventional fastening members 16 enable the rails 9, 10, 11, 14 to be fastened to the walls 4, 5. These fastening members 16 include a portion which forms an integral part of the U-shaped structure 3, 3*a* (of the side wall 5 or the slab 4). Thus, the fastening members can include threaded rods cooperating with bolts enabling the rail to be clamped to its support. In this case, for example, either the threaded rod is the portion of the fastening member forming an integral part of the U-shaped structure 3, 3*a* (the rod being previously arranged inside the mold for the U-shaped structure 3, 3*a*), or an opening for receiving the threaded rod forms an integral part of the U-shaped structure 3, 3*a* (the opening that is considered as forming part of the fastening members 16 is made during manufacture of the U-shaped structure 3, 3*a*).

Furthermore, in the embodiments shown in FIGS. 1 and 2, the fastening members 16 associated with the side rains 10, 11, 14 include a support 17 which is fastened directly to the side wall 5 and which supports all of the side rails 10, 11, 14 associated with the railway track (in this case, three). Furthermore, as concerns the electrical power-supplying side rails 10, 11, the insulators are considered as forming an integral part of the fastening members 16.

Furthermore, in these embodiments, the side walls 5 are shaped so that upper end 18 substantially reaches the level of the deck of the rolling stock 1, so as to form, for example, the edge of a station platform. Furthermore, the upper end 18 extends transversely slightly towards the inside of the U of the U-shaped structure 3, 3*a*, so as to best draw close to the running-boards of the rolling stock 1.

In the first and fifth embodiments shown in FIGS. 1 and 5, each U-shaped structure 3 is associated with a single railway track, and two identical U-shaped structures are arranged one beside the other, a central access platform for the rolling stock 1 running on the two railway tracks being created by the junction of the upper ends 17 of the two adjacent side walls 5 of each U-shaped structure 3. In the track portions shown in FIG. 1, all of the three side rails 10, 11, 14 associated with each railway track are present on each side of each track, and in those shown in FIG. 5, the side rail 10 is present on each side of each track. Correspondingly, each side wall 5 of each U-shaped structure 3 holds all of the side rails 10, 11, 14 associated with the corresponding railway track.

In the second and sixth embodiments shown in FIGS. 2 and 6, a single U-shaped structure 3*a* is associated with two railway tracks adjacent to one another. In the track portions shown in FIG. 2, all of the three side rails 10, 11, 14 associated with each railway track are present on each side of each track. Correspondingly, each side wall 5 of the U-shaped structure 3*a* holds all of the side rails 10, 11, 14 associated with the field side of the corresponding railway track, and a center support 19, fastened to the load-bearing slab 4, between the two railway tracks, holds all of the side rails 10, 11, 14 associated with the gauge side of the two railway tracks. This is also true for the track portions shown in FIG. 6, except that only a single side rail 10 is associated with each track.

In the third, fourth and sixth embodiments, the running rack 6 forms an integral part of the load-bearing slab 4 and it is therefore prefabricated at the same time as the latter (and therefore at the same time as the U-shaped structure 3, 3*a*).

In these embodiments, each row of carrying wheels 7, 8 of the rolling stock 1 rolls on a running rack 6 specific to it. Correspondingly, two running racks 6 integrated with the load-bearing slab 4 (one per row of wheels) are associated with each railway track.

Given that the spans 2 are complete spans and that the U-shaped structures 3, 3*a* are self-supporting structures, in order to achieve this integration, especially as concerns the running rack 6 (and as a result the bearing rails 9), but also to a lesser extent as concerns the side rails 10, 11, 14, a detailed calculation is made of the height of the additional element 6, 9, 10, 11, 14 to be integrated into self-supporting U-shaped structure 3, 3*a*, taking into account the geometry of the U-shaped structure 3, 3*a* during prefabrication, at the moment when prestressing is applied, the long-term deformation of the prefabricated U-shaped element associated with shrinkage and creep problems, and the deformation due to overloading. Furthermore, a detailed inspection of the geometry is also carried out on the prefabrication bed prior to concreting, which is further facilitated by the length of the U-shaped structure 3, 3*a*, the span 2 being in one piece.

Numerous modifications can be made in the embodiments of this invention.

It would also be possible for the U-shaped structure, in particular when it is made of concrete, not to be prefabricated at the factory but made on site, e.g., via formwork. The U-shaped structure could also be made of metal or partially of concrete and partially of metal. The U-shaped structure could be in three parts (the slab and the two side walls) assembled to one another, and not in a single piece.

It would also be possible for each railway track to be associated with only a single running rack serving as a running rack for the two rows of wheels of the rolling stock, and not two running racks as in these embodiments. Furthermore, the rolling stock can be equipped with both wheels with tires and metal wheels supported by the bearing rails.

Depending on the track portions, it is not necessary for all of the side rails associated with one railway track to be present on each side thereof. It would be possible for each railway track to be associated with only a single side rail (either the incoming current side rail, the outgoing current side rail, or the guide side rail) or two side rails, depending on the rolling stock used (on tires, on rails, powered by rail or by a catenary system, as shown in FIG. 4). Furthermore, when there are several side rails associated with one track (two or three rails), it would also be possible for all of the associated side rails to not be all arranged on the same side of the railway track (one side rail on each side when there are two side rails associated with the track, or two side rails on one side and the third side rail on the other side when there are three of them associated).

Furthermore, it would be possible for the members for fastening the side rails to the side walls of the U-shaped structure to include a spacer in order to compensate for the distance transversely separating this side wall from the railway track. As a matter of fact, in particular during turns, it is necessary to move the side walls away from the path of the rolling stock, which must continue to be in contact with the side rails in order to be electrically powered and guided.

As shown in FIG. 4, for the fourth embodiment, the electrical power supply to the rolling stock can be carried out, for all of the embodiments, by a catenary system (solid line) as well as by a side rail (dashes)—(by side rails in the case of equipment having wheels equipped with tires).

The invention claimed is:

1. A span for a railway track, said span comprising:

a prefabricated U-shaped structure made of concrete, defining a portion of a path for a piece of rolling stock running on the railway track, said prefabricated U-shaped structure having a sidewall and a horizontal slab, said horizontal slab including a running rack configured to support said piece of rolling stock; and at least one side rail which enables movement of the rolling stock on the railway track and which is adapted to provide the rolling stock with at least one of a guiding service and a powering service, said at least one side rail being fastened to said side wall of the U-shaped structure by fastening members, and said fastening members including a support which is fastened directly to the side wall and which supports said at least one side rail, said horizontal slab of said prefabricated U-shaped structure configured to be directly supported by a first pier and a second pier of a viaduct, and run between said first and second piers.

2. An assembly for a railway track comprising piers and a span, said span comprising:

a prefabricated U-shaped structure made of concrete, and defining a portion of a path for a piece of rolling stock running on the railway track, said prefabricated U-shaped structure having a side wall and a horizontal slab, said horizontal slab including a running rack configured to support said piece of rolling stock; and at least one side rail which enables movement of the rolling stock on the railway track and which is adapted to provide the rolling stock with at least one of a guiding service and a powering service, said at least one side rail of the railway track being fastened to the side wall of the U-shaped structure by fastening members, said fastening members including a support which is fastened directly to the side wall and which supports said at least one side rail;

said horizontal slab of said prefabricated U-shaped structure configured to be directly supported by the piers.

3. The assembly according to claim 2, wherein said at least one side rail consists of any one of an incoming electric current side rail, an outgoing current side rail, and a guide side rail.

4. The assembly according to claim 2, wherein the fastening members include a spacer adapted to compensate for the distance transversely separating said side wall from the railway track.

5. The assembly according to claim 2, wherein the U-shaped structure is made of a single U piece.

6. The assembly according to claim 2, wherein the U-shaped structure is made of a pre-stressed concrete.

7. A span for a railway track, said span comprising:

a prefabricated U-shaped structure made of concrete, defining a portion of a path for a piece of rolling stock running on the railway track, said prefabricated U-shaped structure having a sidewall, a horizontal slab, and supports for rails, said horizontal slab of said prefabricated U-shaped structure configured to be directly supported by a first pier and second pier of a viaduct, and run between said first and second piers, said horizontal slab including a running rack configured to support said piece of rolling stock.

8. An assembly for a railway track comprising a first pier, a second pier and a span, said span comprising:

a prefabricated U-shaped structure made of concrete, defining a portion of a path for a piece of rolling stock running on the railway track, said prefabricated U-shaped structure having a sidewall and a horizontal slab, said horizontal slab including a running rack configured to support said piece of rolling stock; and rails assembled to said prefabricated U-shaped structure;

said horizontal slab of said prefabricated U-shaped structure configured to be directly supported by said first pier and said second pier, and run between said first and second piers.

9. The assembly according to claim 8, wherein the U-shaped structure is made of a single U piece.

10. A span for a railway track, said span comprising:

a prefabricated U-shaped structure made of concrete, defining a portion of a path for a piece of rolling stock running R on the railway track, said prefabricated U-shaped structure having supports for rails, sidewalls with a upper end, and a horizontal slab, said horizontal slab of said prefabricated U-shaped structure configured to be directly supported by piers, wherein the side walls are shaped so that the upper end substantially reaches a level of a deck of the rolling stock, said horizontal slab including a running rack configured to support said piece of rolling stock.

11. A span for a railway track, said span comprising:

a prefabricated U-shaped structure made of concrete, defining a portion of a path for a piece of rolling stock running on the railway track, said prefabricated U-shaped structure having supports for rails, sidewalls with a upper end, and a horizontal slab, said horizontal slab of said prefabricated U-shaped structure configured to be directly supported by piers, wherein the side walls form the edge of a station platform, said horizontal slab including a running rack configured to support said piece of rolling stock.

* * * * *